United States Patent [19]

Nakajima

[11] Patent Number: 4,802,830

[45] Date of Patent: Feb. 7, 1989

[54] VANE COMPRESSOR WITHOUT OCCURRENCE OF VANE CHATTERING

[75] Inventor: Nobuyuki Nakajima, Konan, Japan

[73] Assignee: Diesel Kiki Co., Ltd., Tokyo, Japan

[21] Appl. No.: 139,646

[22] Filed: Dec. 29, 1987

[30] Foreign Application Priority Data

Jan. 9, 1987 [JP] Japan ..... 62-002883

[51] Int. Cl.[4] ..... F04C 18/344

[52] U.S. Cl. ..... 418/150

[58] Field of Search ..... 418/150, 259

[56] References Cited

U.S. PATENT DOCUMENTS 2,731,919 1/1956 Prendergast ..... 418/150
3,565,558 2/1971 Tobacman ..... 418/150

FOREIGN PATENT DOCUMENTS 60-11601 1/1985 Japan .
62-132289 8/1987 Japan .
539159 12/1076 U.S.S.R. ..... 418/150

*Primary Examiner*—John J. Vrablik
*Attorney, Agent, or Firm*—Frishauf, Holtz, Goodman & Woodward

[57] ABSTRACT

A vane compressor in which a plurality of pumping chambers are defined by a cam ring, side blocks closing respectively opposite axial open ends of the cam ring, a rotor rotatably arranged within the cam ring, and a plurality of vanes slidably fitted for radial movement in an outer peripheral surface of the rotor. The pumping chambers have their respective volumes varying with rotation of the rotor. The cam ring has an inner peripheral camming surface with a cam profile consisting of a first regularly circular portion at which the outer peripheral surface of the rotor is in close contact with the inner peripheral camming surface, an increasing radius portion along which an amount of vane protrusion progressively increases, a constant radius portion along which the amount of vane protrusion is maintained constant, a decreasing radius portion along which the amount of vane protrusion progressively decreases, and a second regularly circular portion at which the rotor outer peripheral surface is in close contact with the inner peripheral camming surface. These portions are arranged in continuous relation to each other in the order mentioned above. Acceleration of vane protrusion is substantially low at an initiating edge of the increasing radius portion.

4 Claims, 7 Drawing Sheets

VANE COMPRESSOR WITHOUT OCCURRENCE OF VANE CHATTERING

BACKGROUND OF THE INVENTION

The pressent invention relates to vane compressors for use, for example, as refrigerant compressors for air conditioning systems of vehicles.

In general, a vane compressor of the kind referred to above comprises a cam ring which has an inner peripheral surface formed into a camming surface and which has opposite axial ends closed by respective side blocks. A rotor is rotatably arranged within the cam ring. The rotor is formed therein with a plurality of axial slits in which vanes are slidably fitted respectively. The side blocks, the cam ring, the rotor and the vanes cooperate with each other to define a plurality of pumping chambers whose respective volumes vary with rotation of the rotor to compress fluid supplied into the pumping chambers.

In the vane compressor arranged as described above, the inner peripheral camming surface of the cam ring has a cam profile which has conventionally been determined based on a curve represented by the expression $\sin^2\theta$ or the like, as disclosed, e.g. in Japanese Provisional Patent Publication (Kokai) No. 60-11601. In the conventional vane compressor comprising the cam ring formed with the inner peripheral camming surface having such cam profile, the tip of each vane is separated or disengaged from the inner peripheral camming surface of the cam ring at a location immediately behind each of regularly circular portions of the inner peripheral camming surface, with reference to the direction of rotational movement of the vane. The regularly circular portions are minor diameter portions where the outer peripheral surface of the rotor is in close contact with the inner peripheral camming surface. Because of such separation or disengagement of the vane tip from the inner peripheral camming surface, chattering of each vane tends to occur, resulting in an increase in fluctuation in torque of the rotor. A cause for such chattering is that the cam profile of the camming surface is designed such that an increasing rate in the amount of protrusion of each vane becomes high abruptly at the location on the inner peripheral camming surface immediately behind each of the regularly circular portions thereof, so that each vane cannot follow the designed increase in the amount of protrusion. If the cam profile of the camming surface is so designed that the increasing rate in the amount of protrusion at the location immediately behind each regularly circular portion is reduced in an attempt to enable each vane to follow the increase in the amount of protrusion, the maximum volume of each pumping chamber is reduced, resulting in a decrease in delivery quantity of the compressor.

SUMMARY OF THE INVENTION

It is an object of the invention to provide a vane compressor which is low in fluctuation in torque of the rotor and high in delivery quantity without occurrence of vane chattering in the compressor, so that mechanical loss of torque can be reduced.

According to the invention, there is provided a vane compressor comprising:

a pump housing including a cam ring having an inner peripheral camming surface and opposite axial open ends, and a pair of side blocks secured to the cam ring to close respectively the opposite axial open ends thereof;

a rotor rotatably arranged within the pump housing, the rotor having an outer peripheral surface formed therein with a plurality of axial slits;

a plurality of vanes slidably fitted respectively in the axial slits;

wherein a plurality of pumping chambers are defined by the side blocks, the cam ring, the rotor and the vanes and vary in volume to compress fluid with rotation of the rotor; and the inner peripheral camming surface of the cam ring having a cam profile consisting of:

a first regularly circular portion at which the outer peripheral surface of the rotor is in close contact with the inner peripheral comming surface of the cam ring;

an increasing radius portion continuous to the first regularly circular portion, each of the vanes having an amount of protrusion progressively increasing along the increasing radius portion;

a constant radius portion continuous to the increasing radius portion, the amount of vane protrusion being maintained constant along the constant radius portion;

a decreasing radius portion continuous to the constant radius portion, the amount of vane protrusion decreasing progressively along the decreasing radius portion; and a second regularly circular portion continuous to the decreasing radius portion, the outer peripheral surface of the rotor being in close contact with the inner peripheral camming surface of the cam ring at the second regularly circular portion, said portions being arranged in the order mentioned above;

wherein acceleration of protrusion of each vane is substantially low at an initiating edge of the increasing radius portion.

The above and other objects features and advantages of the invention will become more apparent from the ensuing detailed description taken in conjunction with the accompanying drawings.

BRIEF DESCRIPTION OF THE INVENTION

DETAILED DESCRIPTION

Figure 1:
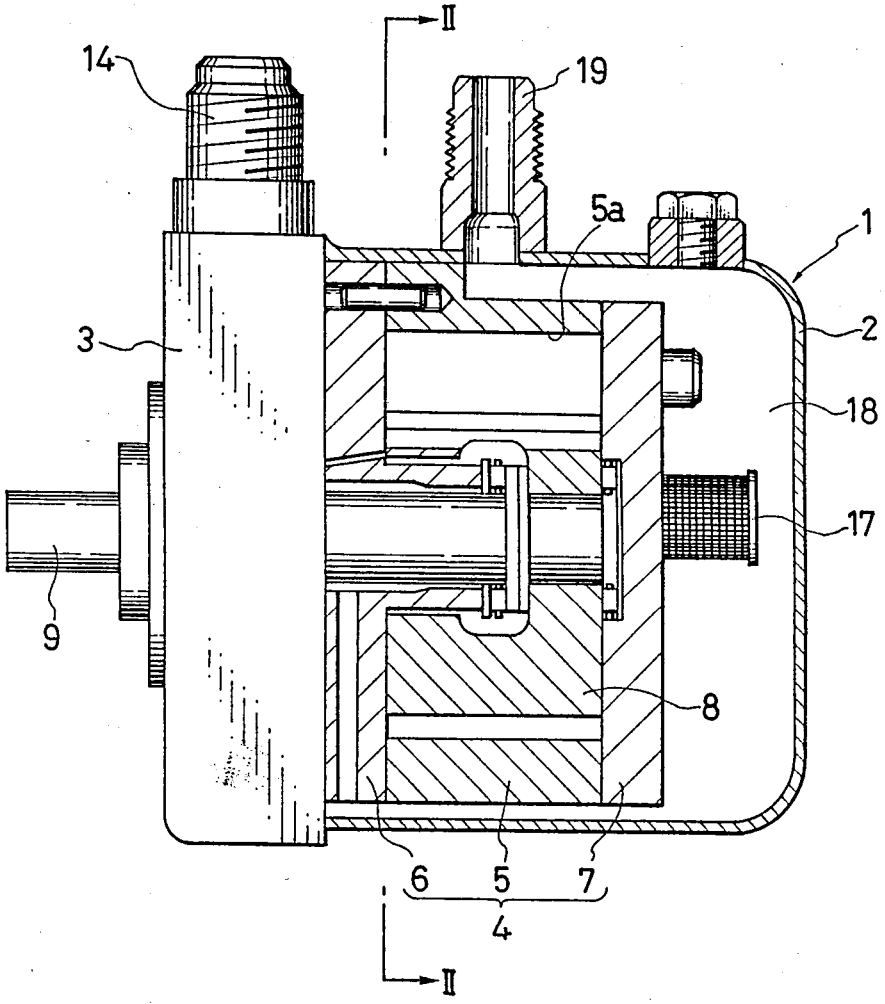
FIG. 1 is a longitudinal cross-sectional view of a vane compressor of double chamber type, to which the invention is to be applied.
Figure 2:
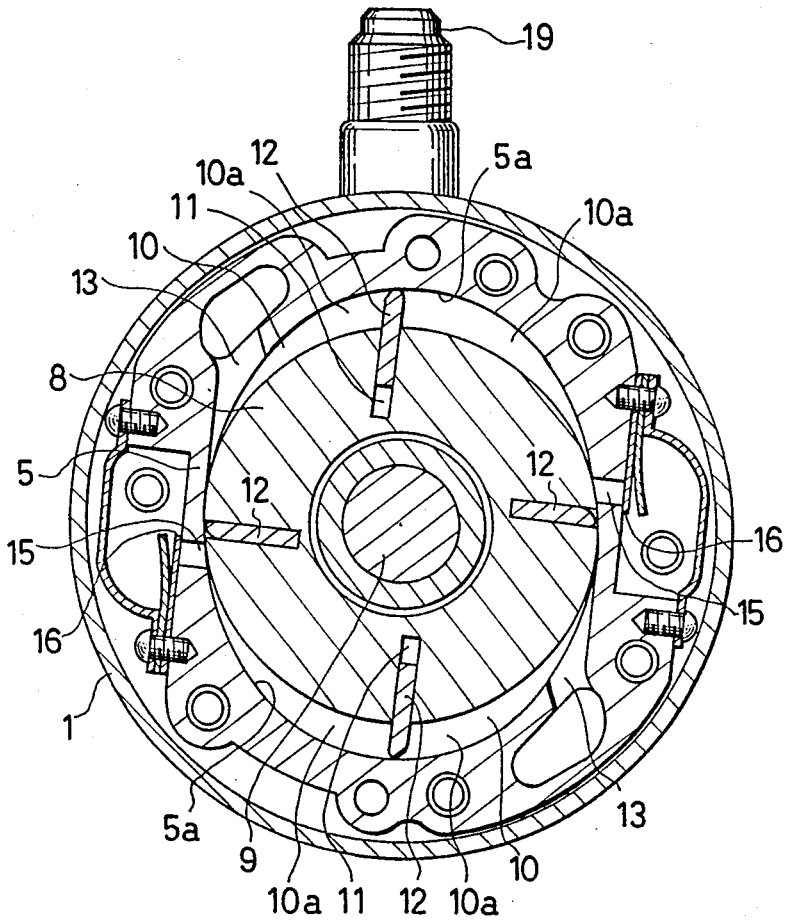
FIG. 2 is a transverse cross-sectional view taken along line II—II in FIG. 1.

Referring to FIGS. 1 and 2, there is illustrated a vane compressor of double chamber type, to which the invention is to be applied. The vane compressor comprises a casing 1 which is composed of a cylindrical shell 2 having one axial open end, and a front head 3 secured to the shell 2 to close the one axial open end thereof. A pump housing 4 is accommodated in the casing 1. The pump housing 4 is composed of a cam ring 5 having opposite axial open ends, and a front side block 6 and a rear side block 7 which are secured &o the cam ring 5 to close respectively the opposite axial open ends thereof. Rotatably arranged within the pump housing 4 is a cylindrical rotor 8 which is mounted on a drive shaft 9 for rotation therewith. Two chambers 10 and 10 are defined in diametrically opposed relation by an inner peripheral camming surface 5*a* of the cam ring 5, an outer peripheral surface of the rotor 8, and inner surfaces of the respective side blocks 6 and 7. The outer peripheral surface of the rotor 8 is formed therein with a plurality of, e.g. four, axial slits 11 arranged in circumferentially equidistantly spaced relation. A plurality of plate-shaped vanes 12 are fitted respectively in the axial slits 11 for radial movement. Thus, as the drive shaft 9 is driven for rotation, the rotor 8 is rotated together with the drive shaft 9. A centrifugal force due to rotation of the rotor 8 and back pressure of lubricating oil acting upon the vanes 12 at the bottoms of the respective axial slits 11 cooperate with each other to cause the vanes 12 to protrude radially outwardly into sliding contact at their respective tips with the inner peripheral camming surface 5*a* of the cam ring 5. With the tips of the respective vanes 12 maintained in sliding contact with the inner peripheral camming surface 5*a*, the vanes 12 move for rotation together with the rotor 8 in the clockwise direction as viewed in FIG. 2. A plurality of pumping chambers 10*a* are defined respectively between the adjacent vanes 12 within each of the chambers 10. Whenever each vane 12 passes by a pump inlet 13 formed through the peripheral wall 5*a* of the cam ring 5, compression fluid is drawn into a corresponding one of the pumping chambers 10*a* during the suction stroke, through a suction connector 14 provided on the front head 3, and a suction chamber, not shown, formed in the front head 3. Each pumping chamber 10*a* has its spatial volume which varies from the minimum value to the maximum value during the suction stroke, and varies from the maximum value to the minimum value during the compression stroke. The fluid drawn into the pumping chamber 10*a* during the suction stroke and compressed in the pumping chamber 10*a* during the compression stroke forces a discharge valve 16 to open and is discharged through a pump outlet 15. This operating cycle is repeated. The compressed fluid passes through an oil separator 17 where lubricating oil mixed with the compressed fluid is separated therefrom. The compressed fluid is discharged into a discharge pressure chamber 18 defined between the casing 1 and the pump housing 4, and subsequently is delivered through a discharge connector 19 provided on the shell 2 into an external heat-exchange circuit, not shown, after temporary staying in the chamber 18.

Figure 3:
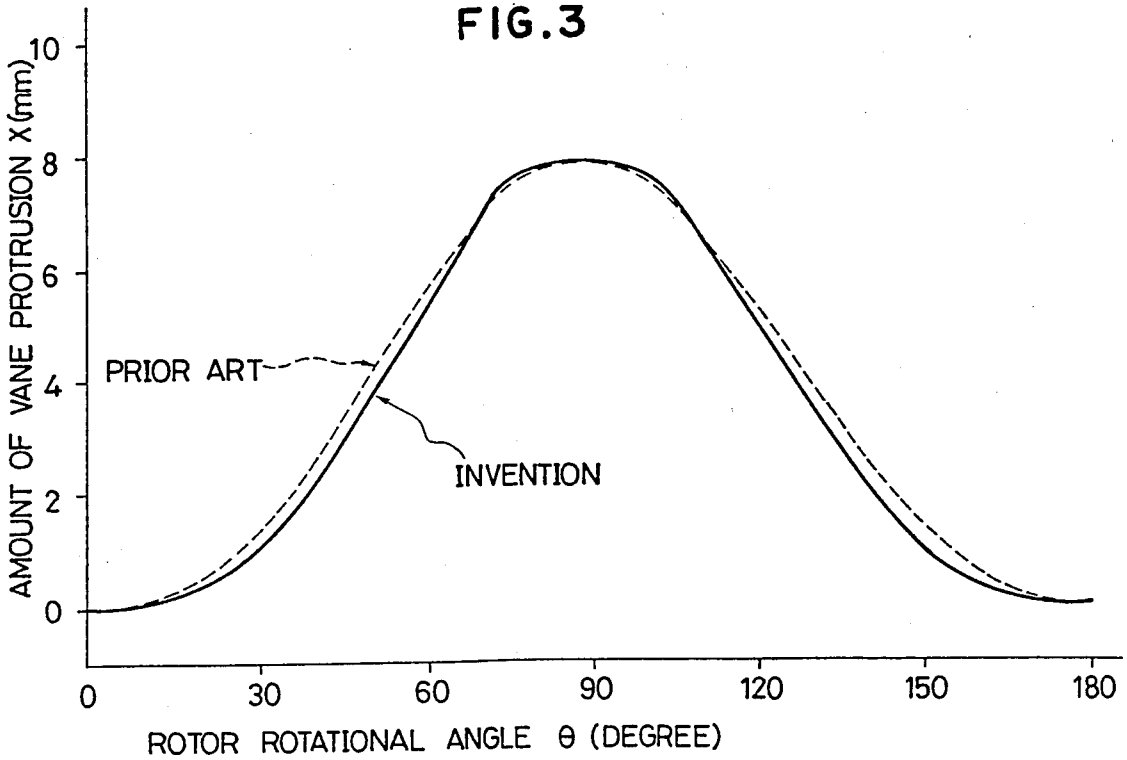
FIG. 3 is a graphical representation of the relationship between rotational angle of a rotor and an amount of protrusion of vanes of a vane compressor according to an embodiment of the invention, in comparison with that of the conventional vane compressor.
Figure 4:
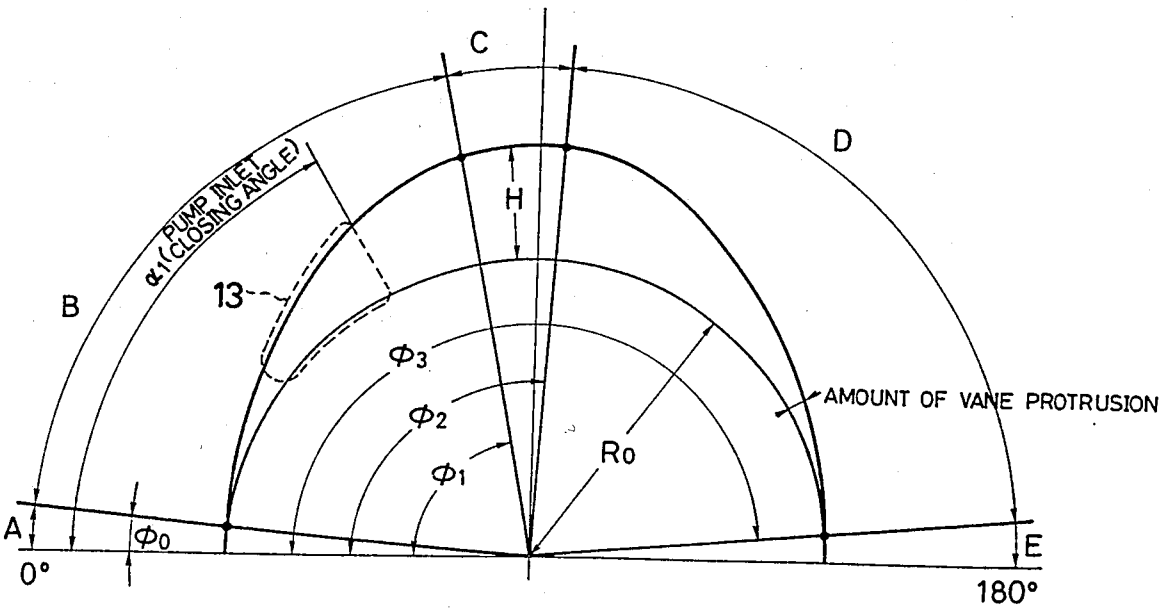
FIG. 4 is a diagrammatic view showing a cam profile of an inner peripheral camming surface of a cam ring in the vane compressor according to the embodiment of the invention.

The cam profile of the inner peripheral camming surface 5*a*, by which the invention is characterized, will next be described. Because the vane compressor according to the embodiment of the invention is of double chamber type, one cycle consisting of suction, compression and discharge strokes is completed through half of one revolution of the rotor 8, i.e., through 180 degrees of the rotational angle of the rotor 8. That is, two cycles are carried out during one revolution of the rotor 8. FIG. 3 is a graphical representation of the relationship between the rotational angle $\theta$ (degree) of the rotor 8 within a range of from 0 to 180 degrees half of one revolution of the rotational angle of the rotor 8, and an amount of vane protrusion X (mm) obtained with the cam profile according to the embodiment of the invention, by calculation using model calculation values. In FIG. 3, the aforesaid relationship is indicated by the solid line, while the broken line indicates the case of the conventional vane compressor for the purposes of comparison. It is supposed in FIG. 3 that the rotational position of the rotor 8 shown in FIG. 2 is 0 degree. The solid line in FIG. 3 presents a locus of the amount of vane protrusion X according to the cam profile of the inner peripheral camming surface 5*a* according to the embodiment of the invention. That is, the basic cam profile of the inner peripheral camming surface 5*a* according to the invention presents a curve as shown in FIG. 4, which consists of the following portions:

(1) a first regularly circular portion A at which the outer peripheral surface of the rotor 8 is in close contact with the inner peripheral camming surface 5*a* of the cam ring 5;

(2) an increasing radius portion B continuous to the first regularly circular portion A, the amount of vane protrusion X progressively increasing along the increasing radius portion B;

(3) a constant radius portion C continuous to the increasing radius portion B, the amount of vane protrusion X being maintained constant along the constant radius portion C;

(4) A decreasing radius portion D continuous to the constant radius portion C, the amount of vane protrusion X progressively decreasing along the decreasing radius portion D; and (5) a second regularly circular portion E continuous to the decreasing radius portion D, the outer peripheral surface of the rotor 8 being in close contact with the inner peripheral camming surface 5*a* of the cam ring 5 at the second regularly circular portion E.

The above-mentioned portions A through E are arranged in the order mentioned above.

The portions A through E have respective cam profiles which may be expressed by the following equalities and inequalities:

(1) the first regularly circular portion A:

$$R(\theta)=R_o' \text{ and}$$

$$0^o \leqq \theta \leqq \phi o$$

(2) the increasing radius portion B:

$$R(\theta) = R_o + H \cdot \sin^{5/2}\left[\frac{90}{\phi 1 - \phi 2}(\theta - \phi)\right], \text{ and}$$

$$\phi_o < \theta \leqq \phi_1$$

(3) the constant radius portion C:

$$R(\theta)=R_o+H, \text{ and}$$

$$\phi_1 < \theta \leqq \phi_2$$

(4) the decreasing radius portion D:

$$R(\theta) = R_o + H - H \cdot \sin^{5/2}\left[\frac{90}{\phi 3 - \phi 2}(\theta - \phi_2)\right], \text{ and}$$

$$\phi_2 < \theta \leqq \phi_3$$

(5) the second regularly circular portion E:

$$R(\theta) = R_o' \text{ and}$$

$$\phi 3 < \theta \leqq 180°,$$

here $R_o$ is a radius of the rotor 8;

H is the maximum amount of protrusion of the vanes 12;

$R(\theta)$ is the amount of protrusion of the vanes 12 + the radius of the rotor 8;

$\theta$ is a rotational angle of the rotor 8;

$\phi_o$ is an angle from the reference point (4°) to the terminating edge of the first regularly circular portion A in the rotational direction of the rotor 8, with respect to the center of the rotor 8:

$\phi_1$ is an angle from the reference point (0°) to the terminating edge of the increasing radius portion B in the rotational direction of the rotor 8, with respect to the center of the rotor 8;

$\phi_2$ is an angle from the reference point (0°) to the terminating edge of the constant radius portion C in the rotational direction of the rotor 8, with respect to the center of the rotor 8; and $\phi_3$ is an angle form the reference point (0°) to the terminating edge of the decreasing radius portion D in the rotational direction of the rotor 8, with respect to the center of the rotor 8.

It is desirable that the angle $\phi_o$ takes the following value:

$$\phi_o = 0° \sim 5°$$

It is desirable that the angle $\phi_1$ takes the following value:

$$\phi_1 = \alpha_1 + (10° \sim 20°),$$

where $\alpha_1$ is a pump inlet closing angle (cf. FIG. (4) which is an angle from the reference point (0°) to the terminating edge of the pump inlet 13 in the rotational direction of the rotor 8.

If the angle $\alpha_1$ is set to an excessively small value, it is impossible to draw a sufficient amount of fluid into each pumping chamber 10*a*. Therefore, it is desirable that the angle $\alpha_1$ is on the order of 60°. Thus, the angle $\phi_1$ is set to the following value:

$$\phi_1 = 70° \sim 80°.$$

If the angle $\phi_2$ is set to an excessively large value, compression is effected abruptly during the compression stroke, resulting in an increase in fluctuation in torque of the rotor 8. Accordingly, it is desirable that the angle $\phi_2$ is set to the following value:

$$\phi_2 = 85° \sim 95°.$$

with the inner peripheral camming surface 5*a* having the cam profile formed as described above, the following characteristics are obtained. That is, the inner peripheral camming surface 5*a* according to the present invention is small in the amount of protrusion of each vane 12 within the range of from about 5° to about 67° of the rotational angle $\theta$ of the rotor 8 as indicated by the solied line in FIG. 3, as compared with the conventional inner peripheral camming surface having the cam profile based on the expression $\sin^2\theta$ or the like as indicated by the broke line in FIG. 3. In addition, the inner peripheral camming surface 5*a* is large in the amount of protrusion of the vane 12 within a range of about 67° to about 109° of the rotational angle $\theta$ of the rotor 8. Moreover, the inner peripheral camming surface 5*a* is low in the amount of protrusion of the vanes 12 within a range of from about 109° to about 175° of the rotational angle $\theta$ of the rotor 8. That is, the amount of protrusion of the vane 12 is low at locations before and behind each of the first and second regularly circular portions A and E, as compared with the conventional one.

Figure 5:
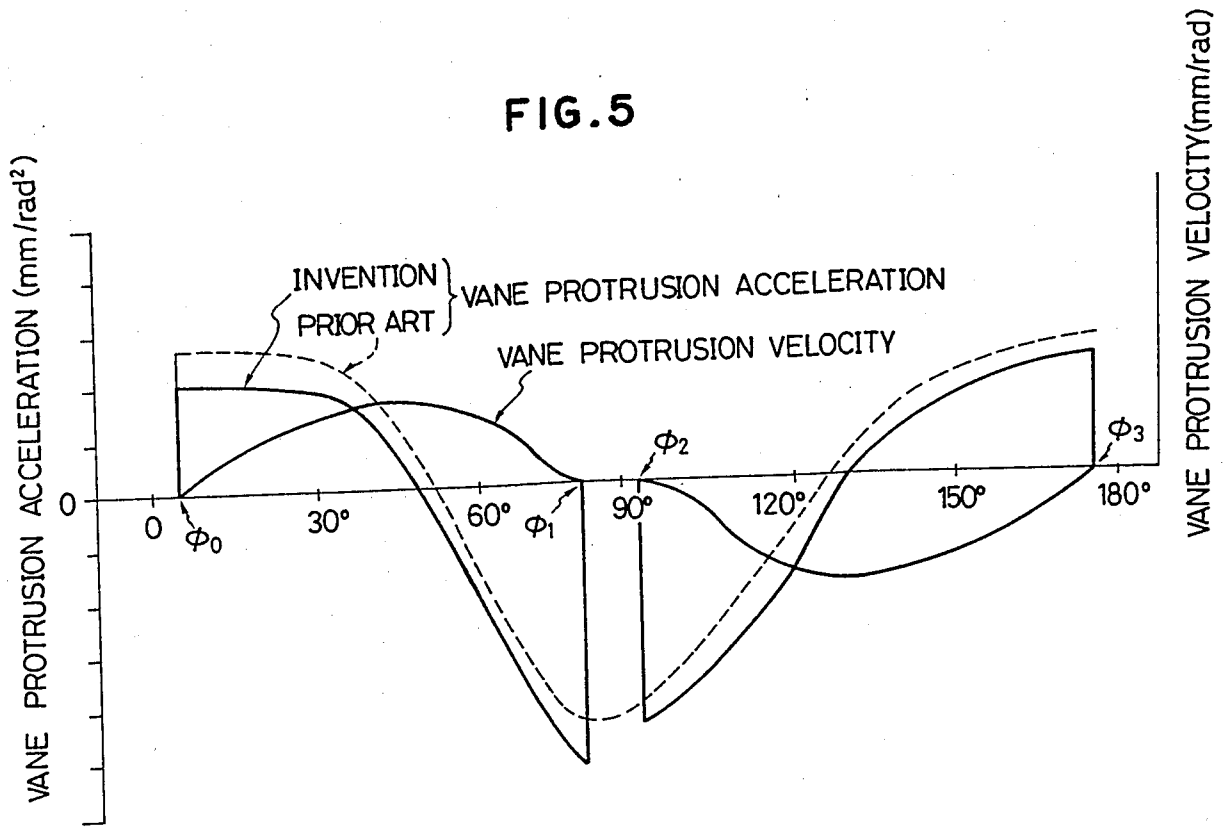
FIG. 5 is a graphical representation of the relationship between the rotational angle of the rotor, vane protrusion acceleration and protrusion velocity in the vane compressor according to the embodiment of the invention, in comparison with that of the conventional vane compressor.

FIG. 5 shows protrusion velocity and protrusion acceleration of the vanes 12 with respect to the rotational angle $\theta$ of the rotor 8. As will be seen from FIG. 5, the vane protrusion acceleration at the location just behind each of the first and second regularly circular portions A and E according to the invention, indicated in the solid line, is low as compared with the conventional vane protrusion acceleration indicated by the broken line, and is particularly low as compared with the conventional one when the vane is in the vicinity of the location immediately behind each regularly circular portion A, E of the inner peripheral camming surface, at which location the amount of vane protrusion begins to increase and at which location chattering tends to occur in the vane compressor. Thus, chattering is prevented from occurring so that fluctuation in torque of the rotor 8 is reduced.

The embodiment of the invention has been described as being applied to the compressor of two chamber type in which the pair of chambers 10 and 10 are arranged within the cam ring in diametrically opposed relation. The invention should not be limited to such specific embodiment, but is applicable to compressors of single chamber type or two or more chamber type.

Further, the invention is applicable to a shell-less type vane compressor disclosed in Japanese Patent Application No. 61-241O19 filed on Oct. 9, 1986.

Figure 6:
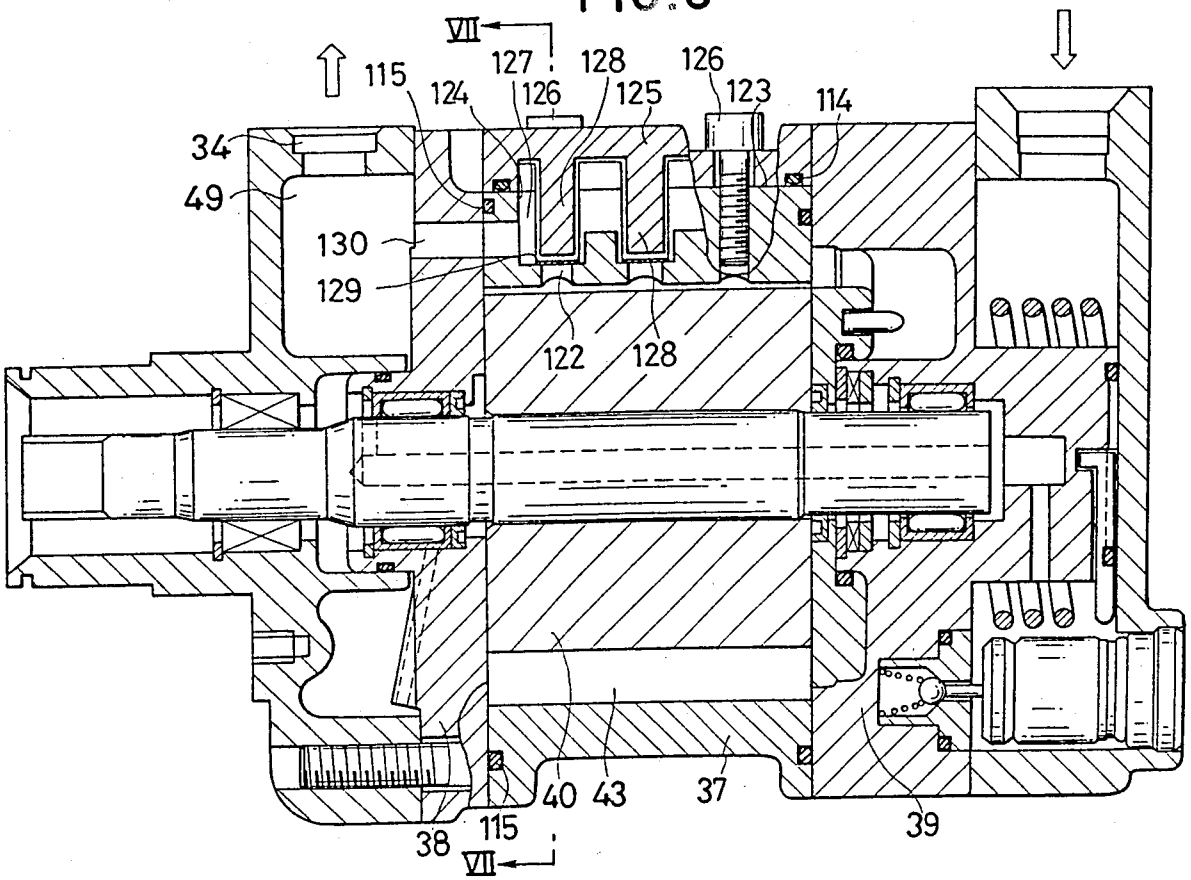
FIG. 6 is a longitudinal cross-sectional view of a variable capacity vane compressor according to another embodiment of the invention.
Figure 7:
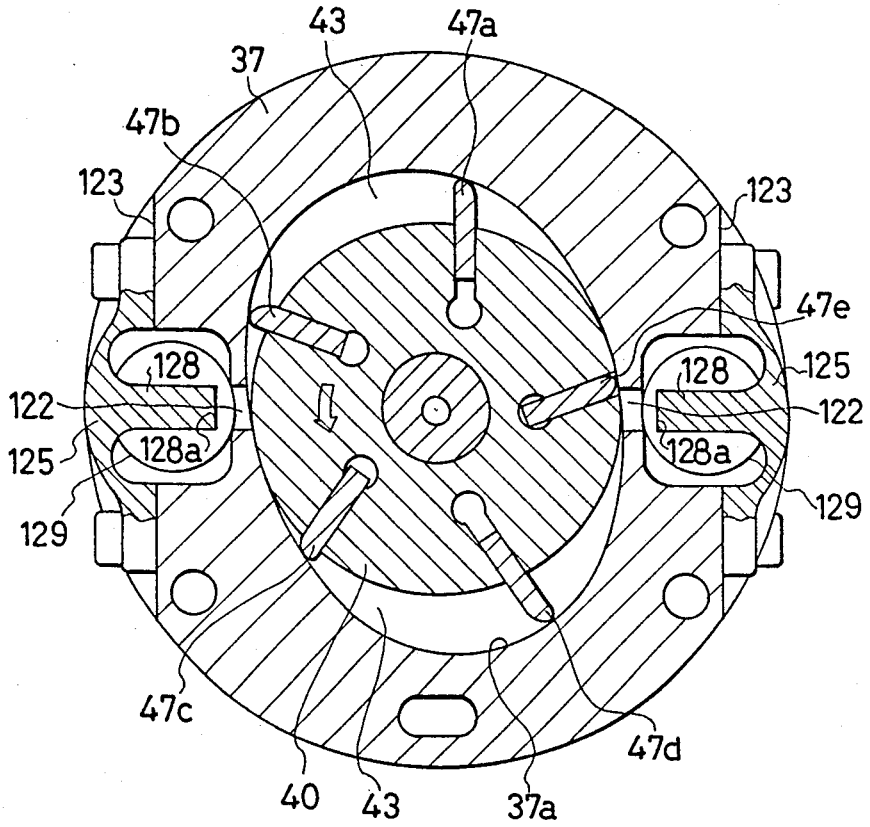
FIG. 7 is a transverse cross-sectional view taken along line VII—VII in FIG. 6.

FIGS. 6 and 7 show another embodiment of the invention applied to a vane compressor of the socalled shell-less type.

In FIGS. 6 and 7, a cam ring 37 forms a casing of the compressor together with a front head 38 and a rear head 39. The cam ring 37 has an inner peripheral camming surface 37*a* with the same cam profile as one shown in FIGS. 2–4 according to the invention. A rotor 40 carrying five vanes 47*a*–47*e* is rotatably fitted within the casing. The cam ring 37 has two sets of refrigerant outlet ports 122, 122 formed through a peripheral wall thereof and arranged at circumferentially opposite locations with respect to the axis of the compressor. The refrigerant outlet ports 122, 122 have one end thereof opening into spaces 43, 43 in the neighborhood of portions with reduced diameter of the peripheral wall of the cam ring 37. Outer peripheral surface portions 123, 123 of the cam ring 37 formed with the refrigerant outlet ports 122, 122 are cut in the form of flat surfaces for mounting covers 125, 125 thereon. The cover-mounting portions 123, 123 have respective recesses 124, 124 (only one of which is shown ) formed therein which each have e.g. three circumferentially extending grooves with arcuate bottom surfaces formed therein. The regrigerant outlet ports 122, 122 have other ends thereof opening into the respective recesses 124, 124.

The covers 125, 125 are screwed respectively to the cover-mounting portions 123, 123 of the cam ring 37 by means of e.g. four mounting bolts 126 two of which are shown). O-rings 114 are interposed between the covers 125, 125 and the cover-mounting portions 123, 123 of the cam ring 37, to maintain airtightness between the recesses 124, 124 and the outside. The covers 125, 125 have respective arcuate recesses formed in inner peripheral surfaces thereof, which form spaces 127, 127 for accommodating discharge valves 129, 129 (one of the spaces is shown), together with the recesses 124, 124 of the cam ring 37. The covers 125, 125 have six stopper portions 128 (two of which are shown) projecting integrally therefrom toward the cam ring 37 and opposed to the respective refrigerant outlet ports 122.

In the spaces 127, 127, the discharge valves 129, 129 are arranged as is known from Japanese Utility Model Publication (Kokai) No. 62-132289. The discharge valves 129, 129 are formed of a single elastic sheet member rolled in a form of cylinder. The cylinder has a slit, not shown, axially extending therethrough and resiliently fit and secured on an axial ridge, not shown, formed on the inner surface of the cover 125, thus being supported by the latter.

The discharge valves 129, 129 have cylindrical end faces thereof in contact with the other ends of the respective regrigerant outlet ports 122, thereby closing the ports 122 except during the discharge stroke of the compressor.

The discharge pressure chamber 49 and the discharge valve accommodating spaces 127, 127 are communicated with each other through communicating passages 130, 130 (one of which is shown) formed in the cam ring 37 and the front side block 38. Respective ends of the passages 130, 130 opening into the spaces 127, 127 are arranged radially inwardly of an O-ring 115 which is interposed between the cam ring 37 and the front side block 38 for maintaining airtightness between the communicating passages 130, 130 and the outside.

With the above construction, during the discharge stroke, the discharge valves 129, 129 are urgedly deformed by the force of compressed regrigerant gas until they are brought into contact with the stopper portions 128, whereby the compressed gas is discharged into the spaces 127, 127. The gas discharged into the spaces 127, 127 is then delivered into the discharge pressure chamber 49 through the communicating passages 130, 130, and then discharged out of the compressor through the discharge port 34.

As described above, according to another embodiment of the invention, the recesses 124, 124 into which the refrigerant outlet ports 122, 122 open are formed in the outer peripheral surface of the cam ring 37, the covers 125, 125 are mounted on the cam ring so as to cover the respective recesses 124, 124, whereby the spaces 127, 127 are formed between the cam ring 37 and the covers 125, 125, in which the discharge valves 129, 129 are arranged, and the communicating passages 130, 130 are formed in the cam ring 37 and the side block to communicate with the spaces 127, 127 with the dischange pressure chamber 49. The casing of the compressor is thus omitted, thereby making the compressor compact in size and reduced in weight. Further, also the compressor of the another embodiment has the inner peripheral camming surface **37*a* with the same cam profile as one in FIGS. 2 and 4. Thus, chattering is prevented from occuring in this compressor so that fluctuation in torque of the rotor 40** is reduced.

What is claimed is:

1. A vane compressor comprising:

a pump housing including a cam ring having an inner peripheral camming surface and opposite axial open ends, and a pair of side blocks secured to said cam ring to close respectively the opposite axial open ends thereof;

a rotor rotatably arranged within said pump housing, said rotor having an outer peripheral surface having a plurality of axial slits formed therein;

a plurality of vanes slidably fitted respectively in said axial slits;

wherein a plurality of pumping chambers are defined by said side blocks, said cam ring, said rotor and said vanes and vary in volume to compress fluid with rotation of said rotor; and said inner peripheral camming surface of said cam ring having a cam profile comprising:

a first regularly circular portion at which the outer peripheral surface of said rotor is in close contact with said inner peripheral camming surface of said cam ring;

an increasing radius portion continuous to said first regularly circular portion, each of said vanes having an amount of protrusion progressively increasing along said increasing radius portion;

a constant radius portion continuous to said increasing radius portion, said amount of vane protrusion being maintained constant along said constant radius portion;

a decreasing radius portion continuous to said constant radius portion, said amount of vane protrusion decreasing progressively along said decreasing radius portion;

a second regularly circular portion continuous to said decreasing radius portion, the outer peripheral surface of said rotor being in close contact with said inner peripheral camming surface of said cam ring at said second regularly circular portion;

said portions being arranged in the order mentioned above;

said portions of said inner peripheral camming surfaces having respective cam profiles determined respectively by the following equalities and inequalities:

(1) said first regularly circular portion:

$$R(\theta)=R_o' \text{ and}$$

$$0° \leqq \theta \leqq \phi_o$$

(2) said increasing radius portion;

$$R(\theta) = R_0 + H \cdot \sin^{5/2}\left[\frac{90}{\phi 1 - \phi 2}(\theta - \phi_0)\right], \text{ and}$$

$$\phi_0 < \theta \leqq \phi_1$$

(3) said constant radius portion:

$$R(\theta)=R_o+H, \text{ and}$$

$$\phi_1 < \theta \leqq \phi_2$$

(4) said decreasing radius portion:

$$R(\theta) = R_0 + H - H \cdot \sin^{5/2}\left[\frac{90}{\phi 3 - \phi 2}(\theta - \phi_2)\right], \text{ and}$$

$$\phi_2 < \theta \leqq \phi_3$$

(5) said second regularly circular portion:

$$R(\theta) = R_o, \text{ and}$$

$$\phi_3 < \theta \leqq 180°,$$

where $R_o$ is a radius of said rotor;

H is a maximum amount of vane protrusion;

$R(\theta)$ is the amount of vane protrusion + the radius of said rotor;

$\theta$ is a rotational angle of said rotor;

$\phi_o$ is an angle from a reference point (0°) of rotation of said rotor to a termination edge of said first regularly circular portion in a rotational direction of said rotor;

$\phi_1$ is an angle from said reference position (0°) to a terminating edge of said increasing radius portion in the rotational direction of said rotor;

$\phi_2$ is an angle from said reference position (0°) to a terminating edge of said constant radius portion in the rotational direction of said rotor; and $\phi_3$ is an angle from said reference position (0°) to a terminating edge of said decreasing radius portion in the rotational direction of said rotor; and wherein acceleration of protrusion of each vane is substantially low at an initiating edge of said increasing radius portion.

2. A vane compressor as defined in claim 1, wherein said angle $\phi_2$ is set to a value within a range of 85° to 95°.

3. A vane compressor as defined in claim 1, wherein aid angle $\phi_1$ is set to a value within a range of 70° to 80°.

4. A vane compressor as defined in claim 3, wherein said angle $\phi_2$ is set to a value within a range of 85° to 95°.

* * * * *